US005761861A

United States Patent [19]

Brackett

[11] Patent Number: 5,761,861

[45] Date of Patent: Jun. 9, 1998

[54] APPARATUS AND METHOD FOR FORMING A REDUCED WEIGHT MASONRY COLUMN

[76] Inventor: Charles Mark Brackett, 490 St. Marys Rd., Lafayette, Calif. 94549

[21] Appl. No.: 629,435

[22] Filed: Apr. 8, 1996

[51] Int. Cl.[6] ..... E04H 12/28

[52] U.S. Cl. ..... 52/218; 52/300; 52/309.12; 52/314; 52/316

[58] Field of Search ..... 52/218, 309.12, 52/314, 316, 300

[56] References Cited

U.S. PATENT DOCUMENTS

| | | | |
|---|---|---|---|
| 3,089,521 | 5/1963 | Paiement | 52/314 X |
| 3,885,008 | 5/1975 | Martin | 52/314 X |
| 4,478,208 | 10/1984 | Pitha | 52/218 X |
| 4,616,457 | 10/1986 | Yoder et al. | 52/218 |
| 4,686,807 | 8/1987 | Newsome | 52/314 |
| 4,727,698 | 3/1988 | Altmann | 52/314 |
| 4,811,534 | 3/1989 | Newsome | 52/314 X |
| 4,875,622 | 10/1989 | Lents | 52/314 X |
| 4,962,621 | 10/1990 | Pura | 52/218 |
| 5,129,203 | 7/1992 | Romero | 52/309.12 X |
| 5,291,706 | 3/1994 | Beardsley et al. | 52/218 |

*Primary Examiner*—Wynn E. Wood

*Attorney, Agent, or Firm*—Flehr Hohbach Test Albritton & Herbert LLP

[57] ABSTRACT

A lightweight stone-work column apparatus (20) including a side wall assembly (20) formed from a plurality of stone-work pieces (32) in side-by-side relation. A mortar material (31) is adhesively mounted to the collective backsides and joints (20) of and between the stone-work pieces (32). This mortar material (31) is supplied in a relatively thin radial depth dimension, relative the longitudinal axis (30), while being sufficient thick to support and bond together the plurality of stone-work pieces (32) together as a unit. A tube member (45) is positioned in a cavity (46), formed by the stone-work pieces (32) and the mortar material (31), in an orientation extending from the first opening (47) to the second opening (48). A polymer backing (20) positioned in a gap between an outer surface of the tube (45) and the backside of the mortar material (31) for strengthening of the collective stone-work pieces (32).

9 Claims, 6 Drawing Sheets

APPARATUS AND METHOD FOR FORMING A REDUCED WEIGHT MASONRY COLUMN

TECHNICAL FIELD

The present invention relates, generally, to stone-work apparatus and, more particularly, relates to an apparatus and a method for forming stone-work column apparatus.

BACKGROUND ART

The addition of brick or stone-work columns and walls for commercial and residential purposes have experience increased growth in recent years. These functional structures are not only aesthetically pleasing, but often increase property value as well. Usually, a mason is required to construct the structure on-site assembling the stone-work pieces in a side-by-side relation, one piece at a time. This construction technique is time-consuming, labor intensive and expensive to implement. Moreover, these structures are generally considered permanent fixtures which are annexed to the realty. Even should the brick or stone structures be removable, their substantial weight poses significant relocation problems.

In an effort to reduce construction costs and weight, and achieve structure mobility, prefabricated stone or brick wall structures have been developed which are less labor intensive to construct on site. Typically, bricks or stones are placed in a template which provides a series of recesses each having the nominal dimensions of a brick or stone. The templates provide a gap or joint between each brick or stone to form a conventional grouting pattern. Subsequently, a concrete backing is poured over the backsides of the laid bricks or stones while the template is secured at a generally horizontal orientation.

For a column-shaped assembly or a two-sided wall structure, however, these prefabricated panels still require on-site assembly to fasten together the panels as a single unit. The fastening is generally accomplished by applying mortar to the cavity formed between the opposing backsides of the respective wall panels. Typical of these patented prefabricated wall panels may be found in U.S. Pat. Nos. 5,268,137; 5,152,937; 4,031,682; 3,642,395; 3,602,476; 3,231,646; 2,465, 871; and 1,968,189.

One problem associated with these references is that the prefabrication of ready-made column structures which are lightweight, yet capable of substantial transport and mobility is difficult to attain. Due to the quantity of mortar applied to the cavity between the opposing backsides of the panels while in an upright orientation, the cumulative weight of the structure is substantial. Hence, while this arrangement provides significant strength, the overall weight of the structure severely impairs the transportation of the prefabricated unit. Accordingly, although the assembled structure may be a little less time consuming and costly to construct, the overall benefits are not substantial.

DISCLOSURE OF INVENTION

Accordingly, it is an object of the present invention to provide an apparatus and method for forming a prefabricated stone-work structure having circumferentially extending side walls.

Another object of the present invention is to provide a method for fabricating a stone-work column structure having generally opposing side walls situated at angles relative one another which are sufficient to cause gravitational flow of uncured mortar material.

Yet another object of the present invention is to provide an apparatus and method for forming a stone-work column structure which is of a relatively light weight.

Still another object of the present invention is to provide a stone-work column structure which is easily transportable.

One other object of the present invention is to provide an apparatus and method for fabricating a stone-work column structure which is modular.

Yet another object of the present invention is to provide a stone-work column structure which is easy to assembly by unskilled personnel.

It is a further object of the present invention to provide a method for fabricating a stone-work column structure which is durable, compact, easy to maintain, and has a minimum number of components.

In accordance with the foregoing objects, the present invention includes a method of forming a relatively lightweight, stone-work structure having a circumferentially extending side wall. The method includes the steps of: (A) providing a mold assembly having a plurality of interengaged panel members each defining a wall portion which collectively cooperate to extend circumferentially about a longitudinal axis thereof. The circumferential extension is by an amount sufficient to enable gravitational flow of uncured mortar material between stone-work pieces when the longitudinal axis is oriented generally parallel to the ground. The next steps of the present invention include (B) orienting the mold assembly to position one interior side of the wall portion in a generally parallel upwardly facing orientation to the ground; and (C) positioning a plurality of stone-work pieces in side-by-side relation in an indexing structure of the one interior side. The indexing structure is formed for receipt and alignment of the front-sides of the stone-work piece therein. Further, the plurality of stone-work pieces collectively and substantially form a portion of the side wall of the stone-work structure. After the positioning step, the present invention includes the step of (D) applying to the collective backsides of each stone-work piece mortar material to a depth sufficient to support and bond together the plurality of stone-work pieces together as a unit.

The method further provides the step of (E) rotating the mold assembly about the longitudinal axis to at least one additional molding position angularly displaced from the position of the orienting step for upward positioning of another interior side of the wall portion generally parallel to the ground. Finally, the method of the present invention includes the steps of (F) sequentially repeating steps (C) through (E) for at least one additional interior side, overlapping the mortar with adjacent portions of the side wall in a manner adhesively joining the plurality of side wall portions together as a unit upon curing of the mortar; and (G) removing the panel members to release the column apparatus.

In another aspect of the present invention, a relatively lightweight, stone-work column apparatus is provided including a side wall assembly formed from a plurality of stone-work pieces in side-by-side relation. These stone-work pieces collectively cooperate to extend circumferentially around a longitudinal axis thereof and forming an exterior side wall. A mortar material is adhesively mounted to the collective backsides of the stone work pieces and in a portion of the joints formed between adjacent stone-work pieces. This mortar material is supplied in a relatively thin radial depth dimension, relative the longitudinal axis, while being sufficient thick to support and bond together the plurality of stone-work pieces together as a unit. This layer of mortar material provides a cavity therein which extends from a first opening to an opposite second opening into the stonework column apparatus. A tube member is positioned in the cavity in an orientation extending from the first opening to the second opening. The present invention further includes a polymer backing positioned in a gap between an outer surface of the tube and the backside of the mortar material for strengthening of the collective stone-work pieces.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
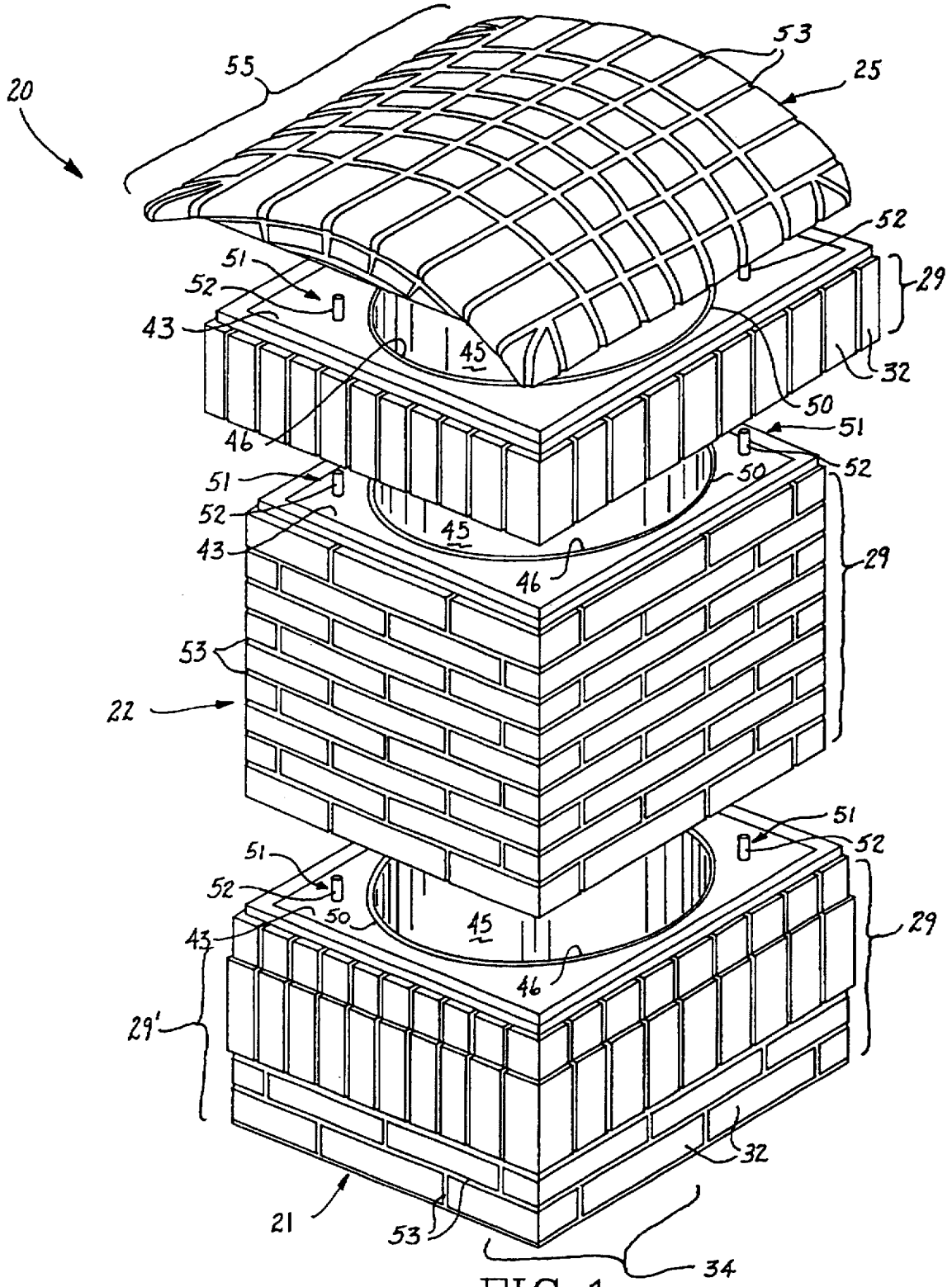
FIG. 1 is an exploded, top perspective view of a modular column structure constructed in accordance with the method of the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Attention is now directed to FIG. 1 where a lightweight stone-work structure, generally designated 20, is illustrated. Briefly, as will be described in greater detail below, stone-work structure 20 is preferably composed of prefabricated modular units (base unit 21, center unit 22, soldier unit 23 and cap unit 25) each of which can be mixed and matched, are relatively lightweight, strong, transportable and durable. Most importantly, the present invention provides a stone-work assembly having an exterior appearance or facade of a custom stone-work structure constructed by masons on site.

Figure 2:
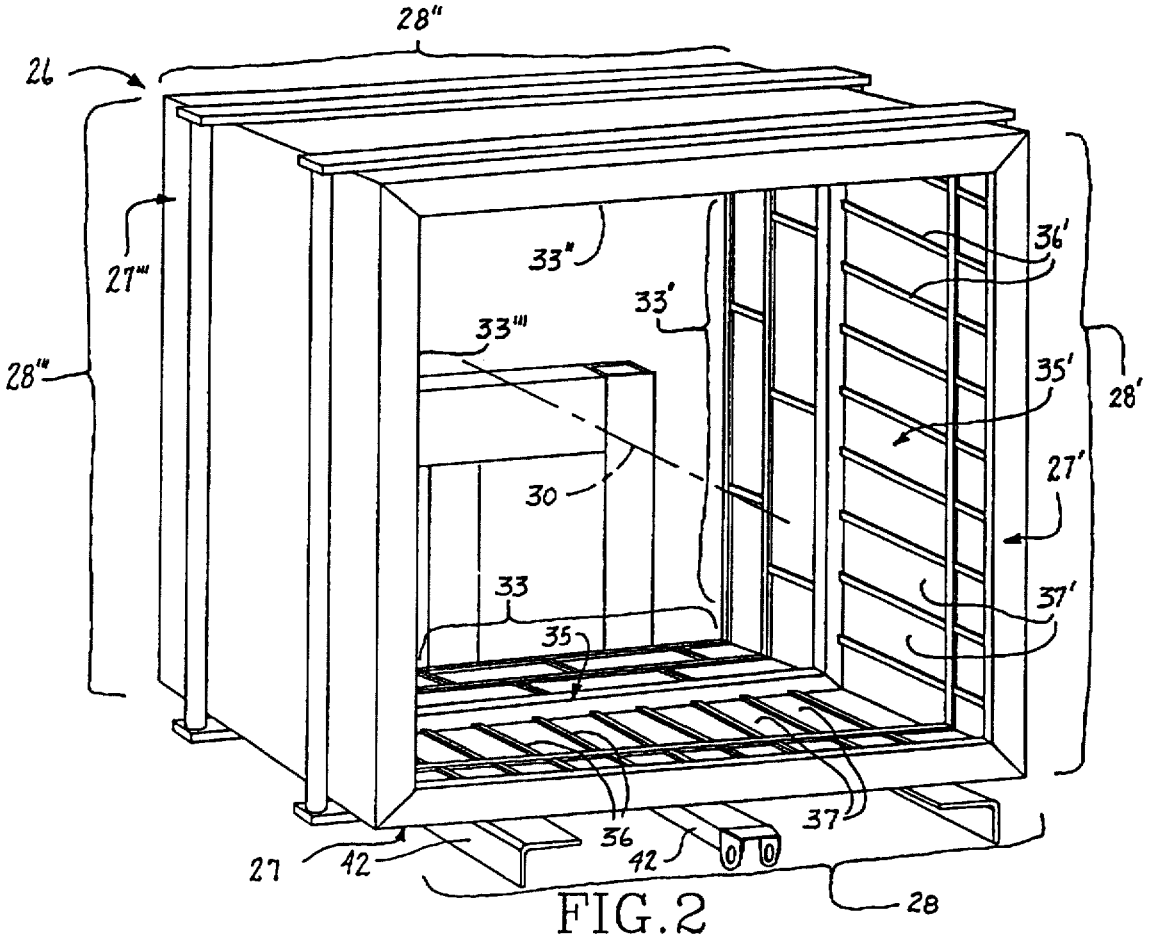
FIG. 2 is a top perspective view of a mold assembly employed in the method of the present invention for a base portion of the column structure of FIG. 1, the mold assembly being positioned on its side to orient one interior side of a wall portion thereof generally parallel to the ground.
Figure 4:
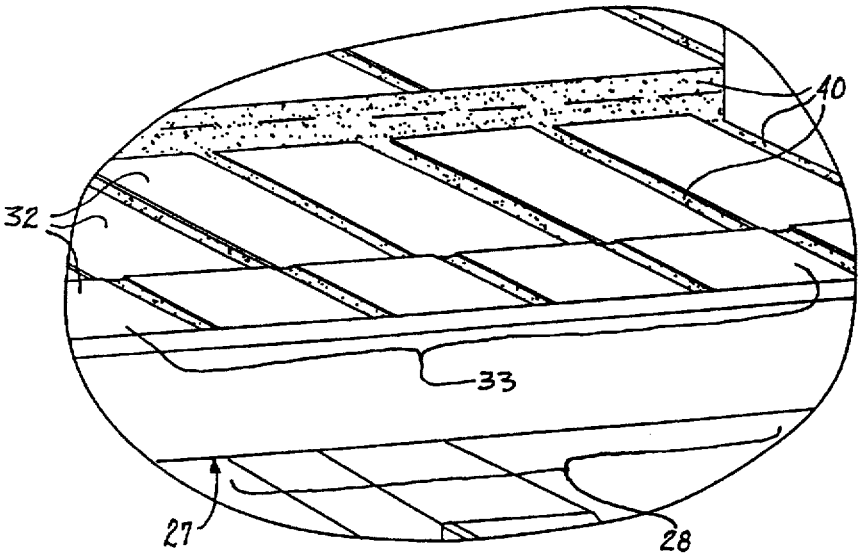
FIG. 4 is a top perspective view of the mold assembly of FIG. 2 during the disposing step, and having granular material disposed in the joints formed between the positioned stone-work pieces.

Each of these modular units is constructed in accordance with the method of the present invention. FIGS. 2–9 illustrate the steps involved in the method for forming the base unit 21 which include: (A) providing a mold assembly, generally designated 26, having a plurality of interengaged panel members 27-27''' (four in the figures) , each defining a wall portion 28-28''' which collectively cooperate to extend circumferentially about a longitudinal axis 30 thereof. The circumferential extension is by an amount sufficient to enable gravitational flow of uncured mortar material 31 between stone-work pieces 32 when longitudinal axis 30 is oriented generally parallel to the ground (FIG. 2). The next steps of the present invention include (B) orienting mold assembly 26 to position one interior side 33 of the corresponding wall portion 28 in a generally parallel upwardly facing orientation to the ground; and (C) positioning a plurality of stone-work pieces 32 in side-by-side relation (FIG. 3) in an indexing structure, generally designated 35, of the one interior side 33. The indexing structure is formed for receipt and alignment of the front-sides of the stone-work pieces 32 therein. Further, the plurality of stone-work pieces 23 collectively and substantially form a portion 29 of an side wall 34 of stone-work structure 20.

Figure 9:
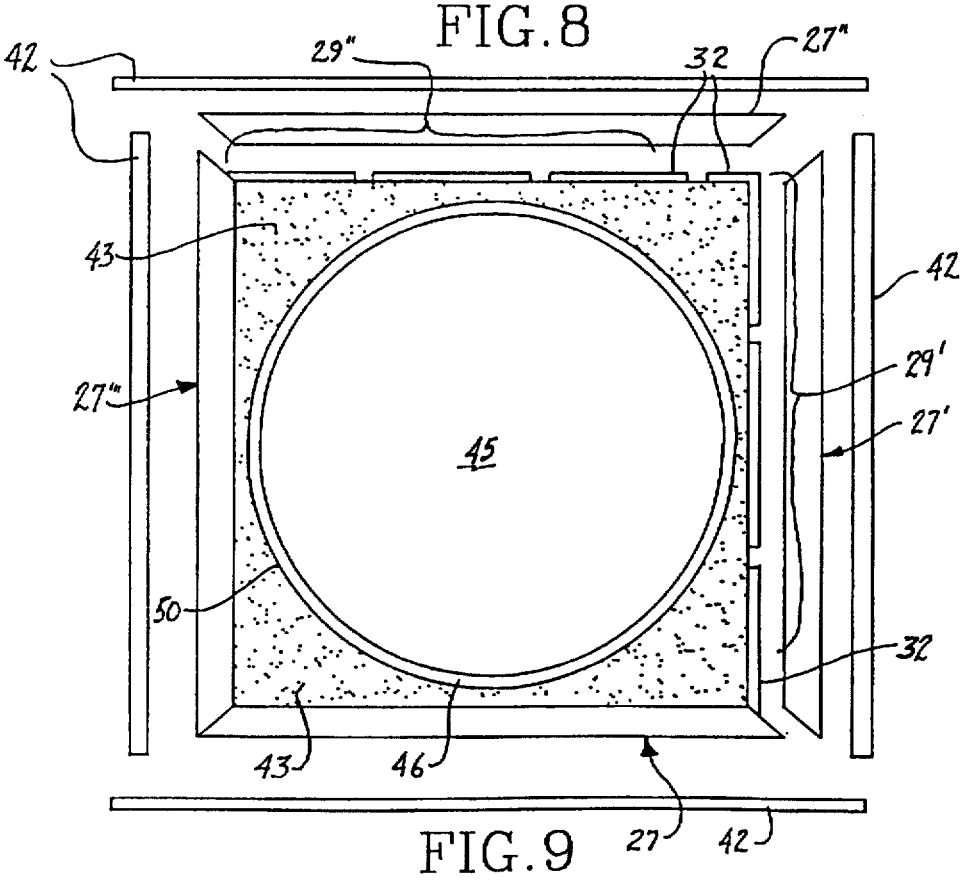
FIG. 9 is a top perspective view of the mold assembly of FIG. 2 during the removing step.

After the positioning step, the present invention includes the step of (D) applying to the collective backsides of each stone-work piece mortar material 31 (FIG. 6) to a depth sufficient to support and bond together the plurality of stone-work pieces together as a unit. The method further provides the step of (E) rotating mold assembly 26 about the longitudinal axis to at least one additional molding position angularly displaced from the position of the orienting step for upward positioning of another interior side 33'-33''' of the corresponding wall portion 28'-28''' generally parallel to the ground (FIG. 7). Finally, the method of the present invention includes the steps of (F) sequentially repeating steps (C) through (E) for at least one additional interior side, overlapping the mortar material with adjacent portions 29-29''' of side wall 34 in a manner adhesively joining the plurality of side wall portions 29-29''' together as a unit upon curing of the mortar; and (G) removing panel members 27-27''' to release column structure 20 (FIG. 9).

Accordingly, a method of prefabrication of a lightweight stone-work structure is provided having a side wall which preferably extend circumferentially around a substantial portion of the longitudinal axis thereof. By orienting the respective wall portion of the mold assembly in a generally horizontal position, during fabrication of the corresponding portion of the side wall, the uncured mortar material applied to the backsides of the stone-work pieces can be properly set to adhere the individual pieces together as a unit. Subsequently, the mold assembly is rotated angularly about the longitudinal axis to position another interior side of the wall portion generally parallel to the ground for assembly of the corresponding portion of the side wall.

The application of prefabricated walls for use in the construction of column assemblies is broadly known. In the above-mentioned prior art references, for example, column construction from prefabricated panels is achieved when the panels are collectively positioned in the generally upright position orienting the backside of each panel generally vertically. Hence, it would not be generally feasible or practical to apply a relatively thin layer of mortar material to the backside to a depth sufficient to support and bond together the plurality of stone-work pieces together as a unit since this quantity of uncured mortar would slough-off the generally vertical backside walls due to the gravitational forces acting on the mortar.

This problem was addressed by either filling the cavity between the opposing backsides completely with mortar, or by placing a spacer member in the cavity to reduce the filling volume of the cavity. In the latter case, mortar would then be poured into the gap provided between the outer surface wall of the spacer member and the opposing backsides walls. In either arrangement, however, a relatively large amount of mortar would be necessary to fill the gap or cavity, each of which substantially increases the cumulative weight of the assembly. Furthermore, the depth of the mortar and the lack of exposed surface area of the uncured mortar substantially increase the curing time thereof.

In the orienting step (C) of the present invention, the one interior side 33 currently being manipulated is positioned in an upwardly facing generally parallel orientation to the ground (side 33 in FIG. 2). During the applying step (D), hence, the uncured mortar material is allowed to sufficiently set and will not slough-off due to gravitational forces.

Referring back to FIGS. 1 and 2, mold assembly 26 is formed to prefabricate a rectangular column structure having four generally planar portions 29-29''' of the side wall 34. In this embodiment, mold assembly 26 is constructed of four interengaged panel members 27-27''' each oriented 90° relative the adjacent panel member. While this embodiment is illustrated for descriptive purposes, it will be appreciated that other geometric configurations can be constructed without departing from the true spirit and nature of the present invention. Such arrangement, for instance, may include circular or other polygon configurations. Moreover, even open configurations may be included provided the wall portions 28 of mold assembly 26 extend circumferentially about a longitudinal axis 30 thereof by an amount sufficient to enable gravitational flow of uncured mortar material 31 between stone-work pieces 32 when longitudinal axis 30 is oriented generally parallel to the ground. For example, a U-shaped of L-shaped configuration may be constructed where adjacent wall portions may be angled relative one another any where in the range of about 90° to about 135°.

Briefly, FIG. 2 illustrates that the interior sides 33-33''' of the respective wall portions 28-28''' include indexing structure 20 enabling the stone-pieces 32 to be aligned and arranged in a side-by-side relation. In the preferred form, indexing structure 20 is provided by a template having a plurality of parallel protruding rib portions 36 cooperating to define rectangular recesses 37. Each recess is formed for receipt of individual stone-work pieces therein. The template is preferably composed of an elastomeric material, such as rubber or other polymer material. The resilient properties exhibited by these elastomeric materials facilitate removal of the side wall portion 29 from the mold assembly.

Each rib portion 36 cooperates with the corresponding recesses 37 to align, orient and space the stone-work pieces an equal distance apart from one another. The depth of the rib portion and spacing or joint 38 created between adjacent stone-work pieces provides a depth and gap, respectively, for grout fill therebetween which will be described in greater detail below.

It will be understood that the stone-work pieces will include any brick-shaped or stone-shaped (real or simulated) object. In the preferred embodiment, the templates 35 of corresponding interior side 33 are formed for receipt of whole or half-bricks stone-work pieces 32 in recesses 37. As best viewed in FIG. 3, half-bricks are preferably employed with the exception of certain corner positions which require whole bricks. The use of half-bricks significantly reduces the cumulative weight of the stone-pieces, while still providing the facade of whole bricks on each side wall 34. This reduced weight concept may be employed half-stone shaped stone-work pieces as well.

Before the positioning step (C), a concrete form release material is preferably administered to the templates of interior side of the wall portion. This release material facilitates release of stone-work pieces 32 from the template of the corresponding panel member 27, after complete fabrication of the stone-work structure, during the removing step (G). In the absence of the concrete release material, individual stone-work pieces 32 may temporarily adhere to the template in the respective recess 37 so that upon separation of the panel members 27-27''' from the corresponding side wall portion 29-29''', the individual stone-work pieces may dislodge from the side wall surface of the stone-work structure.

The release material is preferably provided by BURKE which is common release substance for concrete materials. This release material is generally administered by spraying the same onto the elastomeric template.

Figure 3:
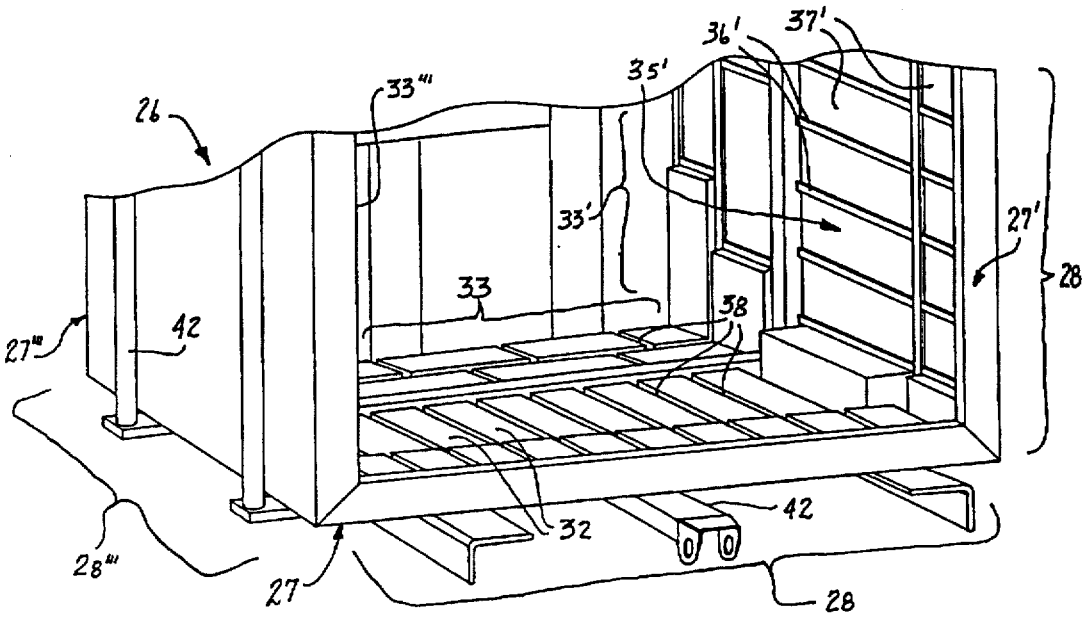
FIG. 3 is a top perspective view of the mold assembly of FIG. 2 during the positioning step, and having stone-work pieces positioned in the recesses formed in the one interior side.
Figure 5:
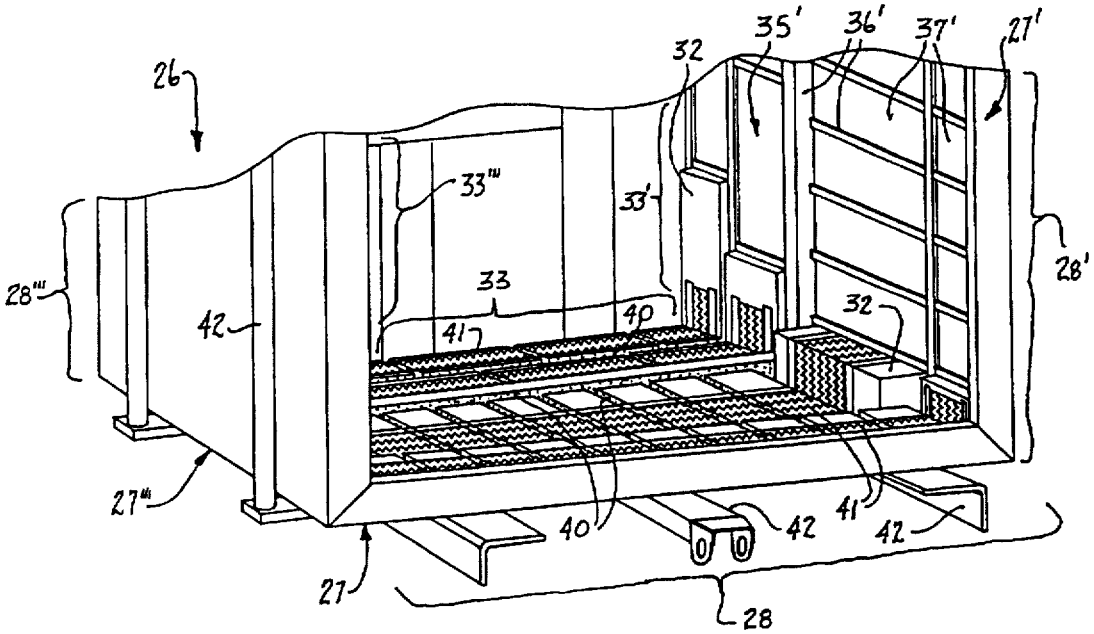
FIG. 5 is a top perspective view of the mold assembly of FIG. 2 during the placing step, and having a rib lath placed against the collective backsides of the stone-work pieces.

Upon completion of the administering step, each recess 37 is filled with the appropriate half-brick or whole brick in the aligned side-by-side manner during the positioning step (C). As shown in FIG. 3, each recess 37 of template 35 is formed for generally snug receipt of a corresponding stone-work piece therein. In some instances, however, the mortar material 31 may flow between the creases and spaces between the template and set stone-work pieces during the application of mortar material into joints 38 in the applying step (D) . As a consequence, mortar stains may developed around the front edges of the stone-work pieces.

To alleviate this problem, after the positioning step (C) and before the applying step (D), a granular material 40 (FIG. 4) may be selectively disposed into joints 38 between adjacent stone-work pieces 32. This granular material 40 provides a simple and effective barrier between the mortar material and the front face of the stone-work pieces to prevent mortar stains. Moreover, since the mortar material physically contacts the granular material rather than the protruding ribs 36 of the interior side 33 of wall portion 28, separation of the set mortar from the granular material is much less problematic.

In the preferred embodiment, the granular material may be provided by sand or the like. This sand is generally disposed or poured into the joints, the excess of which is brushed away to maintain a level just below the back-side face of the half-bricks.

Figure 6:
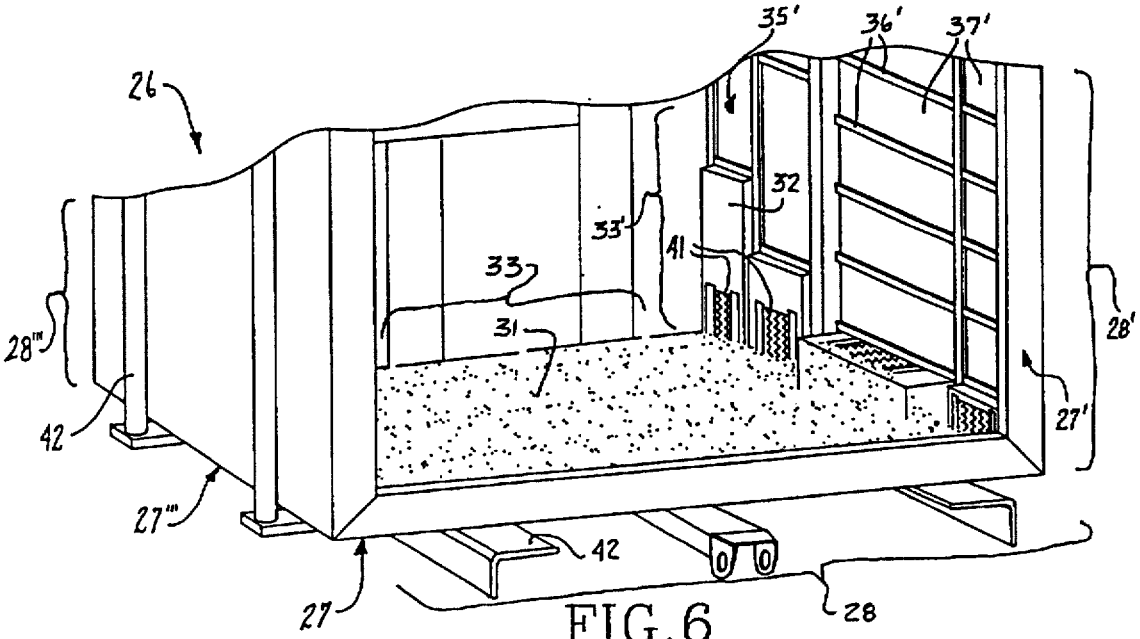
FIG. 6 is a top perspective view of the mold assembly of FIG. 2 during the applying step, and having a quick set mortar material applied over the rib lath and collective backsides of the stone-work pieces.
Figure 7:
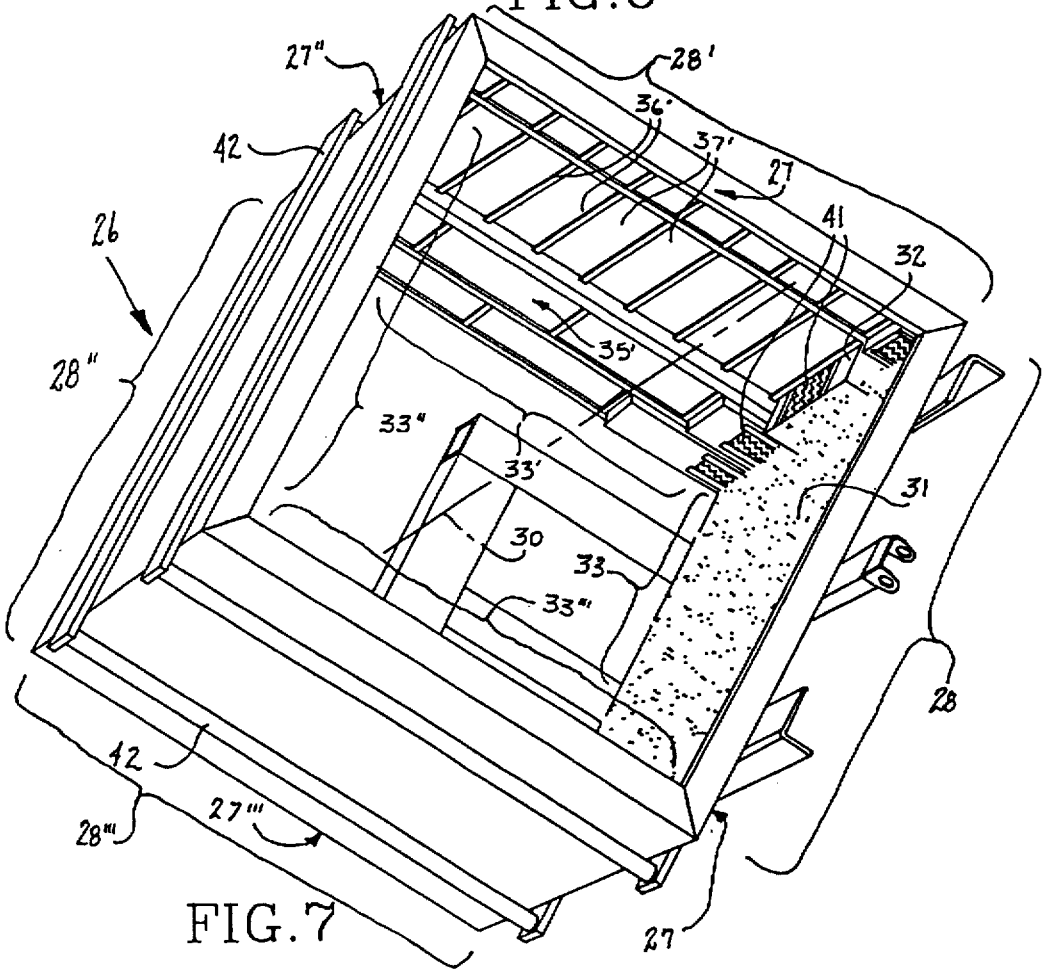
FIG. 7 is a top perspective view of the mold assembly of FIG. 2 during the rotating step where another interior side of the wall portion is upwardly positioned generally parallel to the ground.

To facilitate strengthening of each portion 29-29''' of the side wall 34, a relatively thin supporting structure 41 is placed against the collective backsides of the stone-work pieces (FIG. 6). Accordingly, the combination and cooperation between supporting structure 41 and the quick set mortar substantially adhere and strengthen the stone-work pieces together as a unit.

Supporting structure 41 is preferably provided by a wire mesh or metal rib lath which is capable of manual deformation for conformation with the collective backsides of stone-work pieces. In the preferred form, the step of placing or laying the supporting structure 41 over the stone-work piece backsides is accomplished before the applying step (D). Hence, the uncured mortar material is subsequently worked or massaged into the channels of the rib lath 41 until the mortar material is a sufficient depth to support and bond together the plurality of stone-work pieces together as a unit. For example, for a standard half-brick piece, the depth of the mortar material is anywhere from as little as about ½ inch to about 2 inches.

It will be appreciated, however, that the rib lath could be placed into the uncured mortal material after the mortar had already been applied to the stone-work material backsides. This would be accomplished by shaking or vacillating the rib lath until it sinks into the uncured mortar and rests against the collective stone-work backsides. When applying this technique, the rib lath will need to be set into the uncured mortar material before setting or curing thereof.

This mortar material is preferably provided by a quick set mortar commonly employed in the field. These quick set mortar materials, such as RAPID SET by QUICK CRETE for example, typically set in about 10–20 minutes. Hence, between the applying step (D) and the rotating step (E), the present invention includes the step of waiting a sufficient period of time to enable the mortar material to suitably set by an amount sufficient to prevent gravitational flow thereof when the one interior side and the side wall are angled relative the ground. This assures that the uncured mortar will not slough-off the stone-work piece backsides during the rotating step, and thus, maintain the appropriate depth of the mortar material.

After the sufficient time period has passed, the method of the present invention includes rotating mold assembly 26 about longitudinal axis 30 (FIG. 7) to at least one additional molding position angularly displaced from the position of the orienting step (G) for upward positioning of another interior side of the wall portion generally parallel to the ground. Briefly, mold assembly 26 is suspended and supported on a mounted device 42 which enables rotation thereof about longitudinal axis 30.

As set forth above, the rotating step positions another interior side 33'–33''' of wall portion 28 in an upward position generally parallel to the ground. The amount of angular displacement or rotation of the mold assembly during the rotating step depends in part upon the geometric dimension of the stone-work structure 20. In the rectangular column portion illustrated in FIG. 1, the transverse cross-section is that of a square. Hence, the angular displacement from the position of the last orienting step is preferably about 90°.

In contrast, the angular displacement of a mold assembly for a triangle-shaped column will be about 120°, while the angular displacement of a mold assembly for a circular-shaped column will be much smaller angular increments. For these circular shaped columns and larger polygon sided structures, the amount of angular displacement of the mold assembly will depend upon how large a region of the interior side can be fabricated without gravitational flow of the uncured mortar material occurring that was applied during the applying step (D).

Subsequently, for each wall portion, the orienting step (B), the positioning step (C), the applying step (D), and the rotating step (E) are sequentially repeated until the entire side wall 34 of the stone-work structure 20 is completed and fabricated. Also repeated are the administering step of the release material, the depositing step of the granular material, and the placing step of the rib lath.

At the corners or intersections of the interengaged panels, it will be understood that the mortar will be overlapped at the correspond corners or intersections of the portions 29-29''' collectively forming the side wall 34. This technique of overlapping assures proper joining of the portions 29-29''' of the stone-work structure side wall 34 as a single unit.

After suitable curing of the mortar material for the last remaining side wall portion fabricated, the completed outer shell or frame of the present invention may further be strengthened by applying a lightweight interior backing 43 to the set mortar material. This backing provides base unit 21 with substantially increased structural rigidity without significantly increasing the overall weight of the structure.

Figure 8:
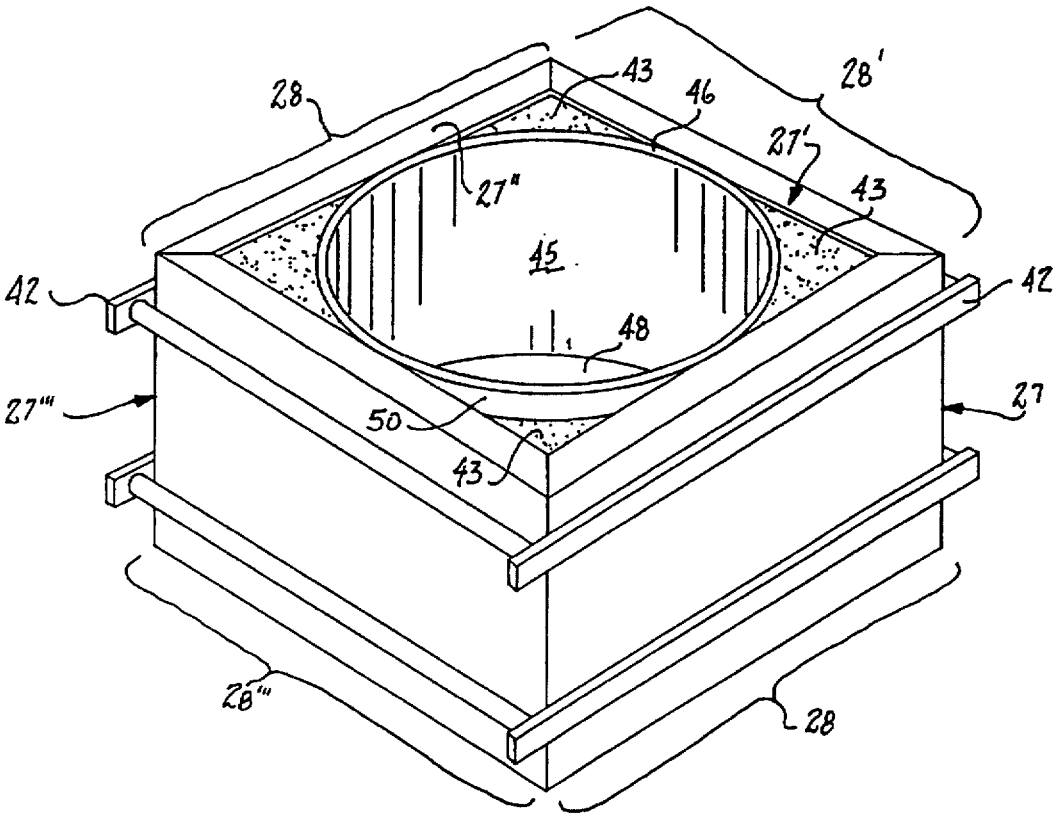
FIG. 8 is a top perspective view of the mold assembly of FIG. 2, positioned generally upright, to apply a polymer backing to the backside of the mortar material to provide additional strength.

In accordance with the present invention and as shown in FIG. 8, the lightweight backing 43 is preferably provided by a lightweight polymer material, such as a foam polyurethane material, applied over the mortar material. Since it is generally not necessary to apply the polymer backing to the whole cavity 45 formed between the opposing backsides of the side wall 34 of the hollow stone-work structure, the backing 43 need only be applied to the outer portions of the cavity over and in contact the mortar material. Therefore, a substantial portion of the cavity remains hollow.

FIG. 8 illustrates that a tube member 46 is inserted into cavity 45 formed between the rear walls of the prefabricated portions 29-29''' of side wall 34 where the tube member preferably extends from a first opening 47 to an opposite second opening 48 of the hollow stone-work structure 20. The foam polyurethane material is then injected between the tube outer surface 50 and the corresponding rear walls. After about 10–25 minutes, the injected foam polyurethane has sufficiently hardened.

The foam polymer backing substantially increases the rigidity and stability of the stone-work structure shell which is composed of the aligned stone-work pieces and corresponding mortar material. This increased strength facilitates transportability and assembly of the stone-work structures, while maintaining a relatively lightweight unit for modularity. By comparison, a complete mortar backing as set forth in the prior art, rather than a foam polymer backing, would weigh substantially more.

As best viewed in FIG. 9, after the polymer backing is applied, the base unit 21 of stone-work structure 20 is removed from mold assembly 26. This is accomplished by removing the interengaged panels members 27-27''' either one-by-one or while partially assembled.

After the panel members are separated from the prefabricated base unit 21, the loose granular material 40 is removed from the cured mortar material 31 in the joints 38 between the aligned stone-work pieces 32. This may be performed by simply brushing or wiping the joints to dislodge the loose sand thereon.

Accordingly, the method of the present invention preferably fabricates a stone-work column structure having an external facade of assembled and aligned stone-work pieces. Since the stone-work pieces may be provided by half pieces which visually appear as a whole piece, the collective weight of the stone-work pieces is substantially less than if they were whole. Moreover, the foam polymer backing material 43 cooperates with the thin layer of quick set mortar to provide a relatively strong, light-weight material fastening the stone-work pieces together as a unit. Moreover, the addition of the rib lath in the mortar further strengthens the structure.

While the stone-work structure 20 could be fabricated as a singular unit, the structure is preferably prefabricated from a plurality of smaller modular units (e.g., base unit 21, central unit 22, soldier unit 23 and cap unit 25 shown in FIG. 1). Each unit is constructed in the manner set forth above, and they are mounted together through a coupling device 51. FIG. 1 illustrates that coupling device 51 is preferably provided by alignment pins 52 strategically situated to enable proper coupling. Each alignment pin is formed for receipt in a corresponding aligned bore (not shown) provided by the mating modular unit. Other forms of coupling devices, however, may be employed.

The modularity of the units, hence, facilitate transportability and assembly of the stonework structure, as well as providing flexibility in desired design. The modular units may be mixed and matched to provide a plurality of different structures.

Once assembled, the present invention includes the step of (J) filling the joints 38 formed between the stone-work pieces with a grout material 53. The grout material, typically provided by BAYSILITE, is applied in a conventional manner performed by a mason. The imperfections of the cured mortar material, caused during the applying step, can then be covered with grout material. This technique further covers the separation lines between the modular units. Hence, a very realistic and clean stone-work structure is fabricated.

Figure 10:
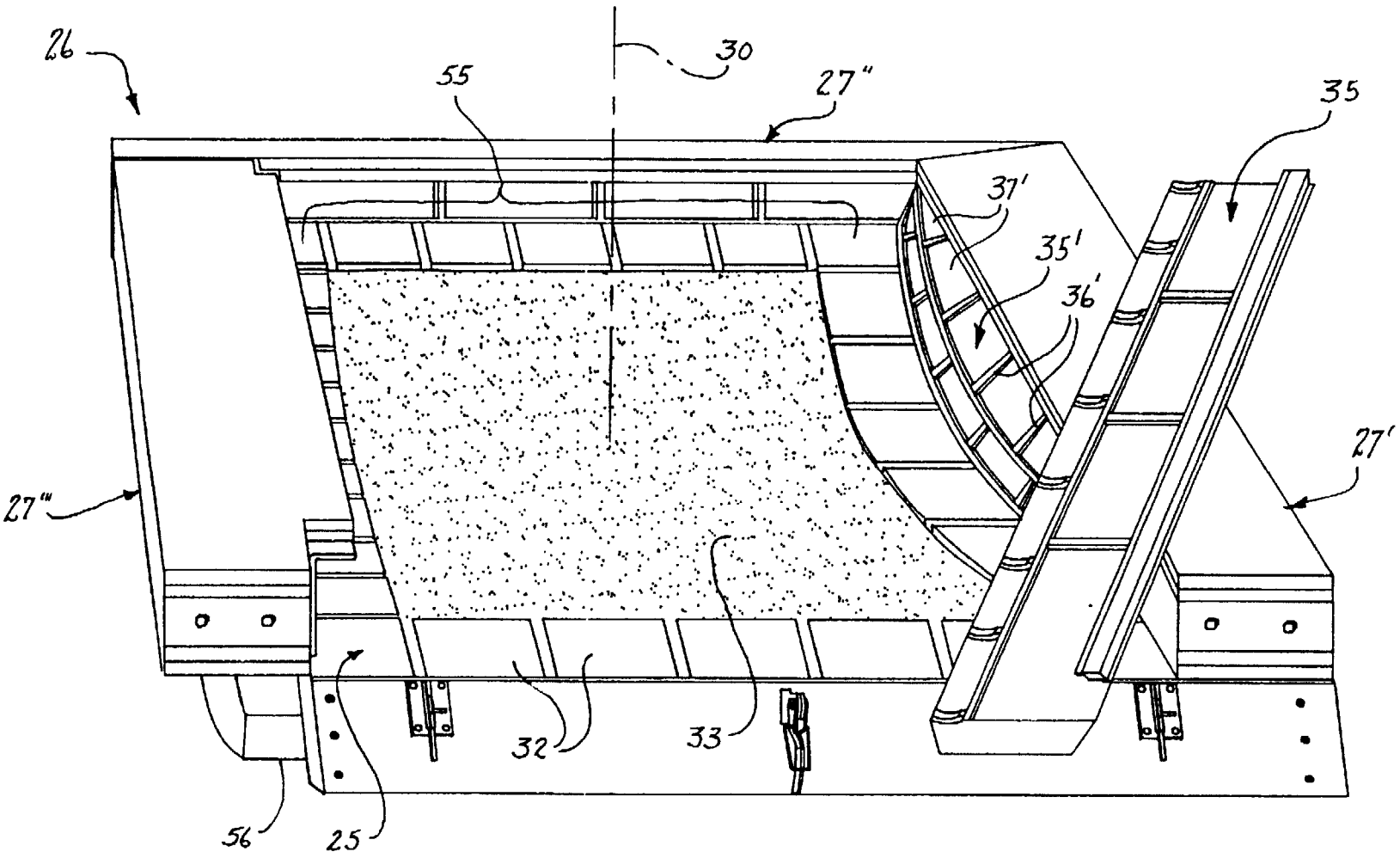
FIG. 10 is a top perspective view of a mold assembly for a cap portion of the stone-work structure of FIG. 1, illustrating partial prefabrication employing the method of the present invention.

FIG. 10 illustrates the fabrication of the cap unit 25 employing the method of the present invention. In this application, a roof 55 of the cap unit stone-work structure is initially fabricated in a roof panel portion 56 of mold assembly 26 in accordance with the present invention. Subsequently, the interengaged side panel members 27-27''' of mold assembly 26 are coupled to the roof panel portion 56 thereof. The mold assembly 26 is then oriented on its side placing the longitudinal axis 30 thereof generally parallel to the ground. The side wall portions (not shown) of the cap unit 25 can then be fabricated employing the method of the present invention.

What is claimed is:

1. A relatively lightweight, masonry column apparatus comprising:

a masonry side wall assembly formed from a plurality of masonry pieces forming an exterior side wall, and a cementations material adhesively mounted to the collective backsides of the masonry pieces and in a portion of joints formed between adjacent masonry pieces, said cementations material having a relatively thin radial depth dimension, relative the longitudinal axis, which is sufficient to support and bond together the plurality of masonry pieces together as a unit, said cementations material further defining a cavity therein extending from a first opening to an opposite second opening into said masonry column apparatus;

a tube member positioned in said cavity in an orientation extending from the first opening to the second opening; and a lightweight backing positioned in a gap between an outer surface of said tube and the backside of the cementations material and through said cavity extending substantially from the first opening to the second opening for strengthening of the collective masonry pieces.

2. The masonry column apparatus as defined in claim 1 further including:

a relatively thin supporting structure interengaged and cooperating with said cementations material to strengthen and support the collective mortar pieces of side wall assembly.

3. The masonry column apparatus as defined in claim 2 wherein, said supporting structure is provided by a rib lath.

4. The masonry column apparatus as defined in claim 1 wherein, the depth of the cementations material is in the range of about ½ inch to about 2 inches.

5. The masonry column apparatus as defined in claim 4 wherein, said cementations material is provided by quick setting mortar.

6. The masonry column apparatus as defined in claim 1 wherein, said exterior side wall of the side wall assembly defines at least three discrete planar surfaces forming a triangular-shaped column.

7. The masonry column apparatus as defined in claim 1 wherein, said exterior side wall of the side wall assembly defines at least four discrete planar surfaces forming a rectangular-shaped column.

8. The masonry column apparatus as defined in claim 2 wherein, said masonry pieces are provided by brick-shaped members.

9. The masonry column apparatus as defined in claim 1 wherein, said lightweight backing is provided by a lightweight polyurethane foam material.

* * * * *

UNITED STATES PATENT AND TRADEMARK OFFICE

CERTIFICATE OF CORRECTION

PATENT NO. : 5,761,861

DATED : JUNE 9, 1998

INVENTOR(S) : CHARLES M. BRACKETT

It is certified that error appears in the above-indentified patent and that said Letters Patent is hereby corrected as shown below:

Claim 1, column 9, line 44, delete "cementations" and insert therefor --cementatious--.

Claim 1, column 9, line 47, delete "cementations" and insert therefor --cementatious--.

Claim 1, column 9, line 50, delete "cementations" and insert therefor --cementatious--.

Claim 1, column 10, line 8, delete "cementations" and insert therefor --cementatious--.

Claim 2, column 10, line 16, delete "cementations" and insert therefor --cementatious--.

Claim 4, column 10, line 25, delete "cementations" and insert therefor --cementatious--.

UNITED STATES PATENT AND TRADEMARK OFFICE

CERTIFICATE OF CORRECTION

PATENT NO. : 5,761,861

DATED : JUNE 9, 1998

INVENTOR(S) : CHARLES M. BRACKETT

It is certified that error appears in the above-indentified patent and that said Letters Patent is hereby corrected as shown below:

Claim 5, column 10, line 29, delete "cementations" and insert therefor --cementatious--.

Signed and Sealed this

Eighteenth Day of August, 1998

Bruce Lehman

*Attest:*

BRUCE LEHMAN

*Attesting Officer*

*Commissioner of Patents and Trademarks*